United States Patent [19]

Klansek

[11] Patent Number: 4,889,307

[45] Date of Patent: Dec. 26, 1989

[54] BOW HANGER

[76] Inventor: William Klansek, 769 Stafford St., Rochdale, Mass. 01543

[21] Appl. No.: 309,405

[22] Filed: Feb. 13, 1989

[51] Int. Cl.[4] ..... F41B 5/00

[52] U.S. Cl. ..... 248/690; 248/303; 124/88

[58] Field of Search ..... 248/214, 215, 301, 303, 248/339, 340, 359 G, 359 H, 359 I, 360, 211, 213; 24/370, 230.5 AD; 124/41 A, 88, 89; 224/916

[56] References Cited

U.S. PATENT DOCUMENTS

| | | | |
|---|---|---|---|
| 2,232,094 | 2/1941 | Canfield | 248/339 |
| 3,094,304 | 6/1963 | Linder | 248/215 |
| 3,150,429 | 9/1964 | Shaffer | 248/214 |
| 3,163,389 | 12/1964 | Thornburgh | 248/211 |
| 3,244,161 | 4/1966 | Jenson | 124/41 A |
| 3,623,468 | 11/1971 | Crest | 124/88 |
| 3,935,854 | 2/1976 | Troncosco | 124/41 A |
| 4,360,179 | 11/1982 | Roberts | 248/309.1 |
| 4,676,465 | 6/1987 | Myotte | 248/340 |
| 4,714,071 | 12/1987 | Saunders | 124/88 |
| 4,748,965 | 7/1988 | Ament | 124/89 |

FOREIGN PATENT DOCUMENTS

| | | | |
|---|---|---|---|
| 2741480 | 3/1979 | Fed. Rep. of Germany | 248/359 I |
| 581092 | 10/1946 | United Kingdom | 248/211 |

*Primary Examiner*—Ramon O. Ramirez
*Assistant Examiner*—Robert A. Olson
*Attorney, Agent, or Firm*—Norman S. Blodgett; Gerry A. Blodgett

[57] ABSTRACT

Hanger for an archery bow having a hook element and a base element which allows the bow to be suspended from a branch or the like.

2 Claims, 1 Drawing Sheet

BOW HANGER

BACKGROUND OF THE INVENTION

There are many instances where it is necessary to store a bow either, temporarily or for long periods of time. In hunting, for instance, the hunter must lay the bow aside temporarily for a number of reasons, including examination of equipment, preparing a hunting stand, or even while having lunch. The temptation is to lay the bow on the ground or lean it against a tree. Since the usual hunting bow is not only beautifully made, but is somewhat delicate (in the case of a compound bow) the possibility of the bow being either damaged or wetted on the ground is considerable. The same problem exists even when the bow is to be stored at home or doing an archery contest. In all situations, the bow is of such a nature that it is difficult to lay it aside without injury. For instance, there is a temptation to place the bow over a nail, in which case the inside surface of the bow and the string can be injured by the nail. This is particularly true if, for some reason or other, a force is applied to the bow. Attempts have been made in the past to provide means for supporting the bow; in general, however, they have been ineffective as well as expensive. These and other difficulties experienced with the prior art devices have been obviated in a normal matter by the present invention.

It is, therefore, an outstanding object of the invention to provide a bow hanger permitting the bow to be supported without possible injury.

Another object of this invention is the provision of a hanger for an archery bow, which hanger remains permanently with the bow and which can be used in a variety of circumstances to suspend the bow.

A further object of the present invention is the provision of a bow hanger which is attached to the bow and which may be used to remove an arrow head of from its embedment in a tree or the like.

A further object of the present invention is the provision of the means for suspending a bow from a branch or the like, which means does not interfere with the operation of the bow and which will not deteriorate when subjected to foul weather and atmosphere.

It is another object of the invention to provide a bow hanger which is simple in construction, which is inexpensive to manufacturer, and which is capable of a long life of useful service with a minimum of maintenance.

SUMMARY OF THE INVENTION

In general the invention consists of a bow hanger having a hook element with a curved portion and a straight spindle, the hanger having a base element with a flat first leg with an aperture to receive the spindle and a flat second leg having a slot for attachment to the bow.

More specifically the straight spindle portion is provided with a threaded portion at its free end and the base element has an L-shaped configuration whose first flat leg has the aperture to receive the said free end of the spindle. The base element has the second flat leg extending at a right angle to the first flat leg and provided with the slot extending generally parallel to the said first flat leg.

BRIEF DESCRIPTION OF THE DRAWINGS

The character of the invention, however, may be best understood by reference to one of its structural forms, as illustrated by the accompanying drawings, in which.

DESCRIPTION OF THE PREFERRED EMBODIMENT

Figure 1:
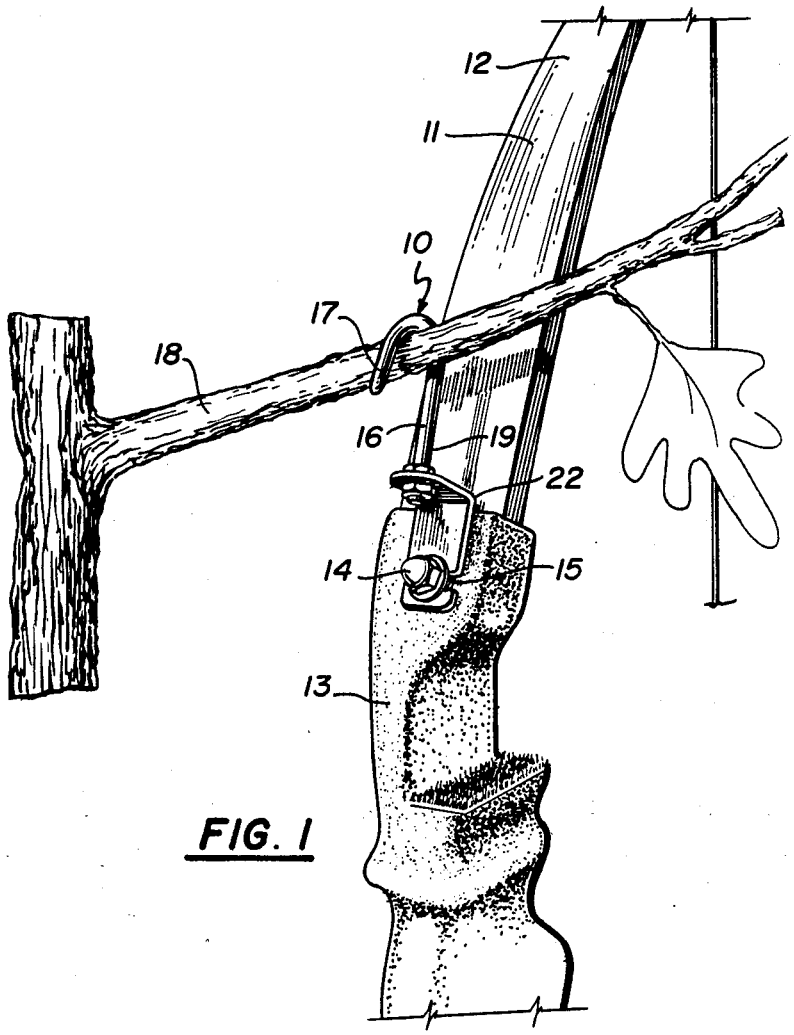
FIG. 1 is a perspective view of a bow hanger embodying the principles of the present invention shown in use with a bow and suspended from the branch of a tree.

Referring first to FIG. 1, wherein are best shown the general features of the invention, the bow hanger, indicated by the reference numeral 10, is shown in use with an archery bow 11 formed with two limbs 12 and 13 joined by a nut 14 and a bolt 15. The bow hanger is provided with a hook element, 16, which on occasion may be looped over a branch 18 of a tree.

Figure 3:
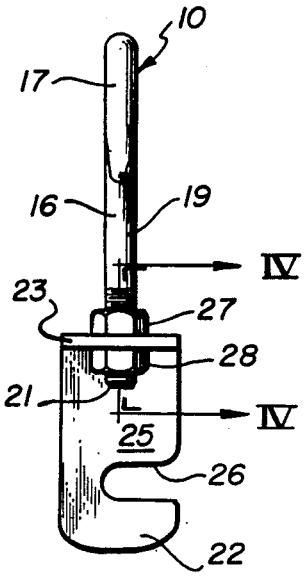
FIG. 3 is a front elevational view of the bow hanger.
Figure 2:
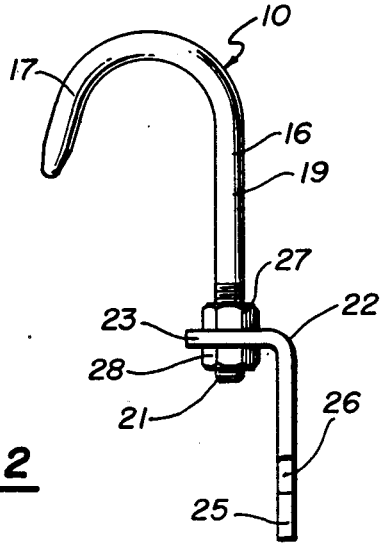
FIG. 2 is a side elevational view of the bow hanger.

Referring now to FIGS. 2 and 3, it can be seen that the hook element 16 has a curved portion 17 and a straight spindle portion 19 the lower free end of which is provided with a threaded portion 21.

The bow hanger is also provided with a base element 22 which is of generally of L-shaped configuration and which has a first flat leg 23 provided with an aperture 24 that is adapted to receive the free end of the spindle 19. The base element also has a second flat leg 25 which extends at a right angle to the first flat leg 23 and is provided with a slot 26 for attachment to the bow. The slot extends generally parallel to the said first flat leg 23.

Figure 4:
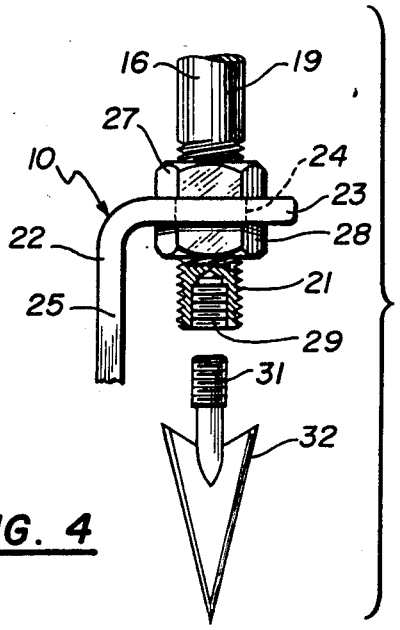
FIG. 4 is a vertical sectional view of the bow hanger taken on the line IV—IV of FIG. 3.

As is best evident in FIG. 4, the spindle 19 of the hook element 16 is locked to the first flat leg 23 of the base element 22 by nuts 27 and 28 which engage the threaded portion 21 on either side of the said first flat leg 23. The free end of the spindle 19 is also provided with a threaded bore 29 which is adapted to engage a threaded spindle 31 on an arrowhead 32 to assist in pulling the arrow from a tree (or the like) in which it is embedded. The slot 26 enters the second flat leg 25 of the base element 22 from one edge thereof and receives the bolt 15 and nut 14 which join the limbs 12 and 13 of the bow to one another.

The operation and the advantages of the present invention will now be readily understood in view of the above description. The bow hanger 10 is permanently attached to the bow 11 by removing the nut 14 from the bolt 15 which joins the limbs 12 and 13 of the bow together. With the nut removed, the bow hanger is inserted by placing the slot 26 of the base member over the bolt and then replacing the nut. When the nut has been tightened, the bow hanger 10 then becomes a permanent part of the bow and, as is evident, it will not interfere in any way with the operation of the bow, since it faces forwardly of the bow away from the strings. When the bow needs to be supported, the owner of the bow simply places the curved portion 17 of the hook elements 16 over a branch 18 or some other convenient horizontal structure. The bow in this position hangs free of the earth, it is then out of harms way and is not subject to acquiring dirt, snow, or water from the ground.

When the bow is brought home, it can be stored on a nail, wire, or pipe without damaging the bow in any way, since the operative and ornamental parts of the bow do not come in contact with other surfaces.

It often happens, particularly in hunting, that a valuable arrow misses its target and is embedded in a tree; it is usually difficult to remove the arrow (and it is possible also to damage the arrow) by pulling on the shaft. For that reason, it is only necessary with the present invention to remove the bow hanger 10 from the bow and to remove the shaft of the arrow from the embedded arrowhead; it is then possible to thread the threaded bore 29 over the threaded shank 31 of the arrow head 32. The hook element 16 can be used as a pulling device to remove the arrow head from the tree. The shaft of the arrow is then rejoined to the head and the bow hanger 10 is replaced on the bow.

It can be seen, then, that, by the use of the present invention, it is possible to arrange for hanging the bow in a number of places out of harm way where it is not subject receiving dirt and water or being stepped on or knocked over by the owner or by other persons. In addition, when the hunter is climbing up into a tree stand, it is possible to attach a rope or string to the hook and pull the bow upwardly to the stand without injury to the bow.

It is obvious that minor changes may be made in the form and construction of the invention without departing from the material spirit thereof. It is not, however, desired to confine the invention to the exact form herein shown and described, but it is desired to include all such as properly come within the scope claimed.

The invention having been thus described, what is claimed as new and desired to secure by Letters Patent is:

1. Bow hanger for use with an archery bow that has two limbs joined by a nut and bolt, comprising (a) a hook element having a curved portion adapted to rest on a branch or the like and a straight spindle portion provided with a threaded portion at its free end, (b) a base element of L-shaped configuration having a first flat leg with an aperture adapted to receive the said free end of the spindle, the base element having a second flat leg extending at a right angle to the first flat leg with a slot extending generally parallel to the said first flat leg, wherein the spindle is locked to the first leg of the base element by nuts engaging the threaded portion on either side of the first flat leg, and wherein the said free end of the spindle is provided with a threaded bore adapted to engage a threaded spindle on an arrow head to assist in pulling the arrow from an embedment.

2. Bow hanger for use with an archery bow that has two limbs joined by a nut and bolt, (a) a hook element having a U-shaped portion adapted to rest on a branch or the like and a straight spindle portion provided with a threaded portion at its free end, (b) a base element of L-shaped configuration having a first flat leg with an aperture adapted to receive the said free end of the spindle, the base element having a second flat leg extending in a plane at a right angle to the plane of the first leg with a slot extending generally parallel to the said first leg, wherein the spindle is locked to the first flat leg of the base element by nuts engaging the threaded portion on either side of the first flat leg, and wherein the slot enters the second flat leg from an edge thereof to receive the bolt and nut that joins the limbs of the bow.

* * * * *